US006196858B1

(12) United States Patent
Matsumoto et al.

(10) Patent No.: US 6,196,858 B1
(45) Date of Patent: Mar. 6, 2001

(54) CIRCUIT BREAKING DEVICE

(75) Inventors: Mitsuhiro Matsumoto; Masahiro Deno, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/360,638

(22) Filed: Jul. 26, 1999

(30) Foreign Application Priority Data

Sep. 4, 1998 (JP) ..... 10-251500

(51) Int. Cl.[7] ..... H01R 13/627
(52) U.S. Cl. ..... 439/354; 335/132; 337/194
(58) Field of Search ..... 439/354, 358, 439/357; 335/132; 200/293–308

(56) References Cited

U.S. PATENT DOCUMENTS

| | | | | |
|---|---|---|---|---|
| 4,559,504 | * | 12/1985 | Krec | 337/194 |
| 5,785,546 | * | 7/1998 | Hamai et al. | 439/354 |
| 5,830,002 | * | 11/1998 | Ito et al. | 439/358 |
| 5,859,580 | * | 1/1999 | Hashizawa et al. | 337/260 |
| 6,033,252 | * | 3/2000 | Hood et al. | 439/374 |

* cited by examiner

*Primary Examiner*—Lincoln Donovan
*Assistant Examiner*—Brian S. Webb
(74) *Attorney, Agent, or Firm*—Sughrue, Mion, Zinn, Macpeak & Seas, PLLC

(57) ABSTRACT

The circuit breaking device 10 includes a plug box 20 including circuit terminals 21 and 22 respectively connected to the respective open ends of two electric circuits, and a plug main body 30 including short-circuit terminals 31, 32 and disposed in such a manner that it can be shifted by a given amount with respect to the plug box 20; in particular, the plug main body 30 is structured such that not only it can bring the short-circuit terminals 31 and 32 into fit with the circuit terminals 21 and 22 of the plug box 20 to thereby close the two electric circuits, but also it can remove the short-circuit terminals 31 and 32 from the circuit terminals 21 and 22 to thereby open the two electric circuits and thus cut off the circuit currents thereof. The plug main body 30 is allowed to shift with respect to the plug box 20 between the actually securing position where the short-circuit terminals 31, 32 can be fitted with the circuit terminals 21, 22 and the temporarily securing position where the short-circuit terminals 31, 32 can be removed from the circuit terminals 21, 22.

7 Claims, 7 Drawing Sheets

CIRCUIT BREAKING DEVICE

BACKGROUND OF THE INVENTION

1. Field of Invention

The present invention relates to a circuit breaking device and, in particular, to a circuit breaking device which, when checking and maintaining an electric car, a hybrid car or a similar car which includes a high-voltage circuit used to drive a motor, can cut off the circuit current of the high-voltage circuit temporarily.

2. Related Art

In recent years, when checking and maintaining a car such as an electric car, a hybrid car or a similar car which is in the spotlight as a low-pollution car and includes a high-voltage circuit used to drive a motor, in order to prevent an operator from getting an electric shock, it is necessary to cut off the circuit current of the high-voltage circuit temporarily.

In view of this, in a conventional electric car or the like, as a circuit breaking device for cutting off the circuit current of a high-voltage circuit temporarily, there is proposed a circuit breaking device which comprises a plug box including a circuit terminal connected to the open end of an electric circuit, and a plug main body including a short-circuit terminal and structured such that it can bring the short-circuit terminal into fit with the circuit terminal of the plug box to thereby close the electric circuit.

According to the above-mentioned conventional circuit breaking device, when checking and maintaining the electric car or the like, an operator pulls the plug main body out of the plug box completely and removes the short-circuit terminal of the plug main body from the circuit terminal of the plug box, there by being able to open the electric circuit and thus cut off the circuit current of the electric circuit.

However, in the above-mentioned conventional circuit breaking device, in a state where the plug main body is pulled out of the plug box completely in the car check and maintenance, on the plug box, there is exposed a terminal insertion hole through which the short-circuit terminal of the plug main body can be inserted. Therefore, there is a fear that the fingertips of the operator or a conductive part (a wire or the like) can be inserted into the terminal insertion hole by mistake to thereby come into contact with the circuit terminal provided within the plug box. In order to prevent the operator's fingertips or conductive part from coming into direct contact with the circuit terminal, it is necessary to work the plug box specially, with the result that the structure of the plug box is complicated.

Also, since the plug main body pulled out of the plug box is separated completely from the plug box, there is a fear that the plug main body can be lost by accident.

SUMMARY OF THE INVENTION

The present invention aims at eliminating the above-mentioned drawbacks found in the conventional circuit breaking device. Accordingly, it is an object of the invention to provide an improved circuit breaking device which not only is capable of opening and closing an electric circuit quickly and easily but also is high in safety and can eliminate a fear that a plug main body can be lost.

In attaining the above object, according to the invention, there is provided a circuit breaking device, comprising:

a plug box including a circuit terminal connected to the open end of an electric circuit; and, a plug main body including a short-circuit terminal and disposed in such a manner that it can be shifted by a given amount with respect to the plug box, the plug main body being able not only to bring the short-circuit terminal into fit with the circuit terminal of the plug box to thereby close the electric circuit but also to remove the short-circuit terminal from the circuit terminal to thereby open the electric circuit and thus cut off the circuit current of the electric circuit, wherein the plug main body is allowed to shift with respect to the plug box between an actually securing position where the short-circuit terminal can be fitted with the circuit terminal and a temporarily securing position where the short-circuit terminal can be removed from the circuit terminal.

According to the above-mentioned structure, when checking and maintaining an electric car or the like, an operator, by shifting the plug main body from the actually securing position to the temporarily securing position, can remove the short-circuit terminal from the circuit terminal of the plug box to thereby open the electric circuit and thus cut off the circuit current of the electric circuit.

Therefore, even when the electric circuit is cut off, the plug main body is prevented from being separated completely from the plug box and thus the plug main body at the temporarily securing position is able to cover the upper portion of the circuit terminal.

By the way, preferably, in the plug main body, there may be formed protective peripheral side walls which cooperate with the plug main body at the temporarily securing position to be able to cover the circuit terminal.

According to the present structure, the protective peripheral side walls are able to cover the obliquely upper portion of the circuit terminal that cannot be covered completely only the plug main body.

Also, preferably, the plug main body may be prevented at the temporarily securing position from shifting in a direction to part away from the plug box by plug main body removal preventive means which is disposed in the plug box.

According to the present structure, even if an operator tries to shift the plug main body at the temporarily securing position further in the direction to part away from the plug box with a greater operation force than necessary, the plug main body, which is blocked by the plug main body removal preventive means, is prevented from shifting any further; that is, there is eliminated the possibility that the plug main body can be removed from the plug box in error.

Further, preferably, the plug main body may be held at the temporarily securing position because a temporarily securing projection provided on the flexible locking arm is engaged with the portion to be secured formed in the plug box, and, to shift the plug main body from the temporarily securing position to the actually securing position, while flexing the locking arm to thereby remove the engagement between the temporarily securing projection and the portion to be secured, the plug main body may be shifted.

According to the present structure, to shift the plug main body from the temporarily securing position to the actually securing position, there are necessary two operations: in particular, one operation to flex the locking arm to thereby remove the engagement between the temporarily securing projection and the portion to be secured; and, the other operation to shift the plug main body, which is held at the temporarily securing position, to the actually securing position.

Therefore, according to the present plug main body, the fitting operation to fit the short-circuit terminal with the circuit terminal is carried out in two stages or by two actions, which eliminates the possibility that, even if the plug main body, which is held in the temporarily secured state, is energized unexpectedly by an external force in the actually securing position direction, the short-circuit terminal can be fitted with the circuit terminal in error.

More preferably, between the temporarily securing projection and the portion to be secured, there may be formed a tapered surface which, when shifting the plug main body from the temporarily securing position to the actually securing position, can flex the locking arm in an engagement removing direction to thereby remove the engagement of the temporarily securing projection with respect to the portion to be secured.

According to the present structure, to shift the plug main body from the actually securing position to the temporarily securing position, there is necessary only the operation to shift the plug main body, which is held at the actually securing position, in the temporarily securing position direction, while there is eliminated the need for the operation to flex the locking arm.

Accordingly, by removing the short-circuit terminal of the plug main body from the circuit terminal, the cutoff operation to open the electric circuits to thereby cut off the circuit current of the electric circuit can be turned into one action, which can facilitate the cutoff operation.

Also, preferably, on the plug main body, there may be projectingly provided a pair of arm protective walls which are opposed to each other with the locking arm between them and also which are able to protect the locking arm.

According to the present structure, since the locking arm can be protected by the arm protective walls, there can be prevented the possibility that an undesired external force can be applied directly to the lock arm to thereby damage the same.

DETAILED DESCRIPTION OF PREFERRED EMBODIMENT

Now, description will be given below in detail of an embodiment of a circuit breaking device according to the invention with reference to the accompanying drawings.

Figure 1:
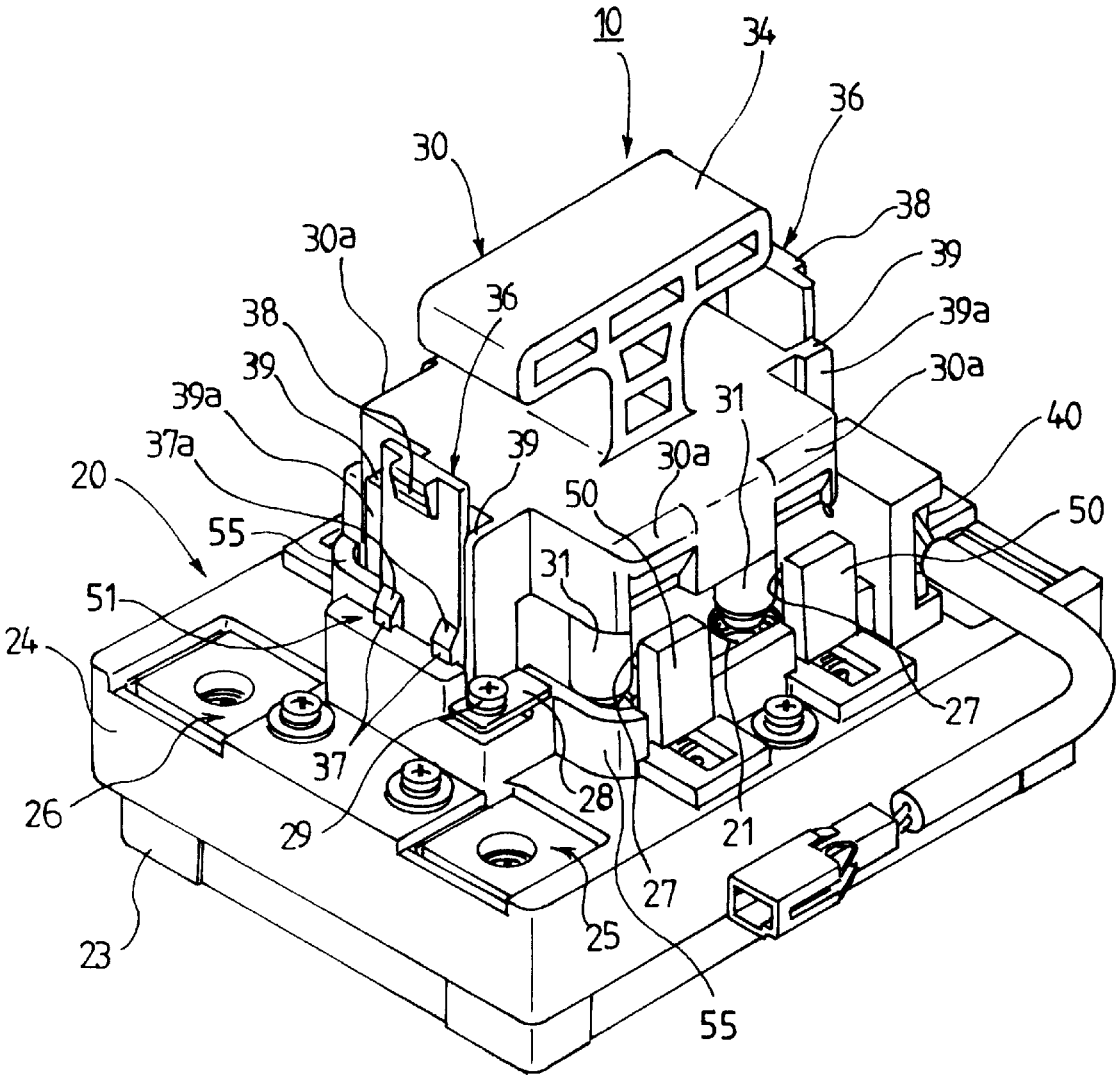
FIG. 1 is a perspective view of the whole of a circuit breaking device according to an embodiment of the invention, showing a temporarily secured state thereof.
Figure 2:
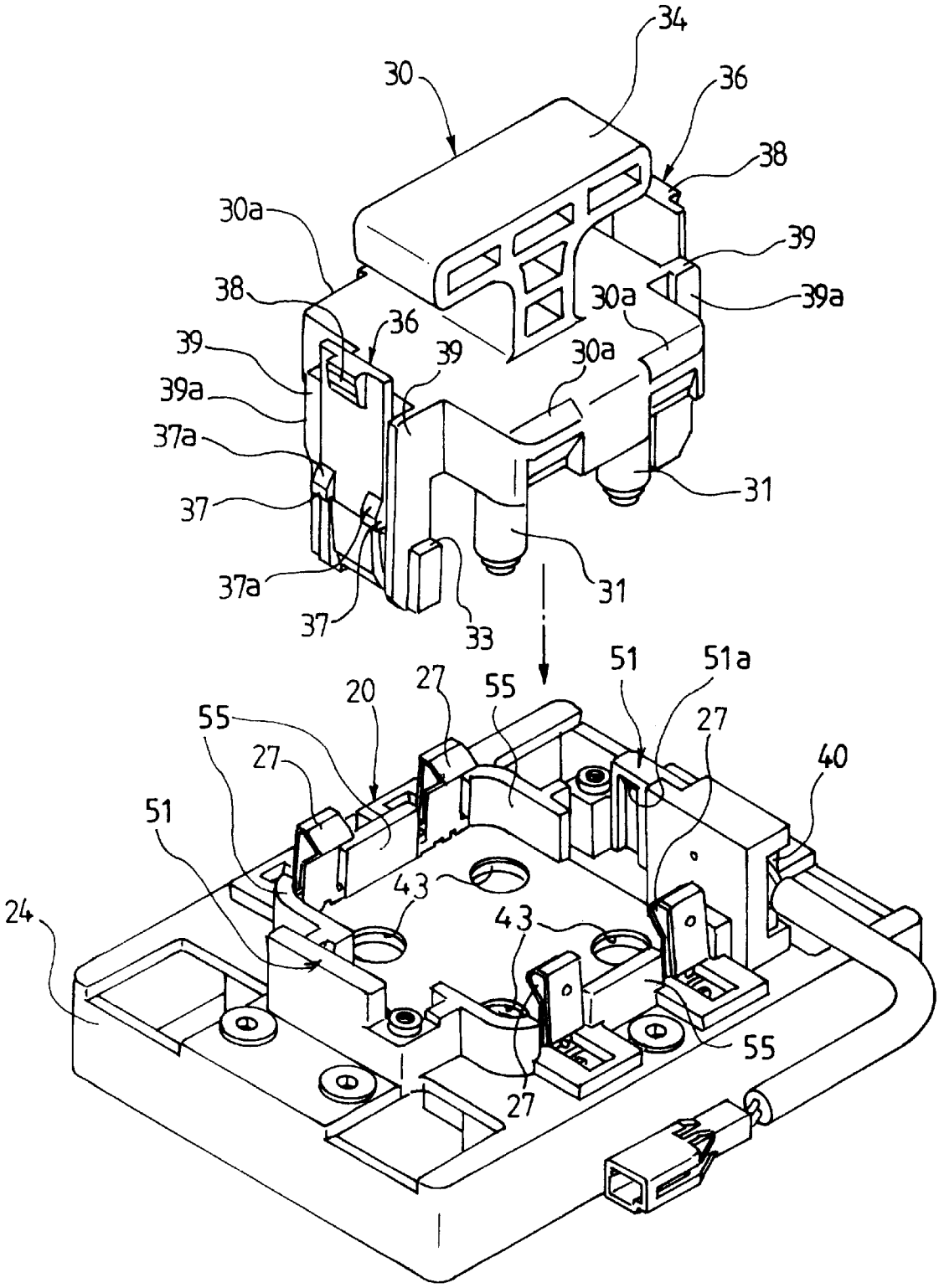
FIG. 2 is an exploded perspective view of the main portions of the circuit breaking device shown in FIG. 1.
Figure 3:
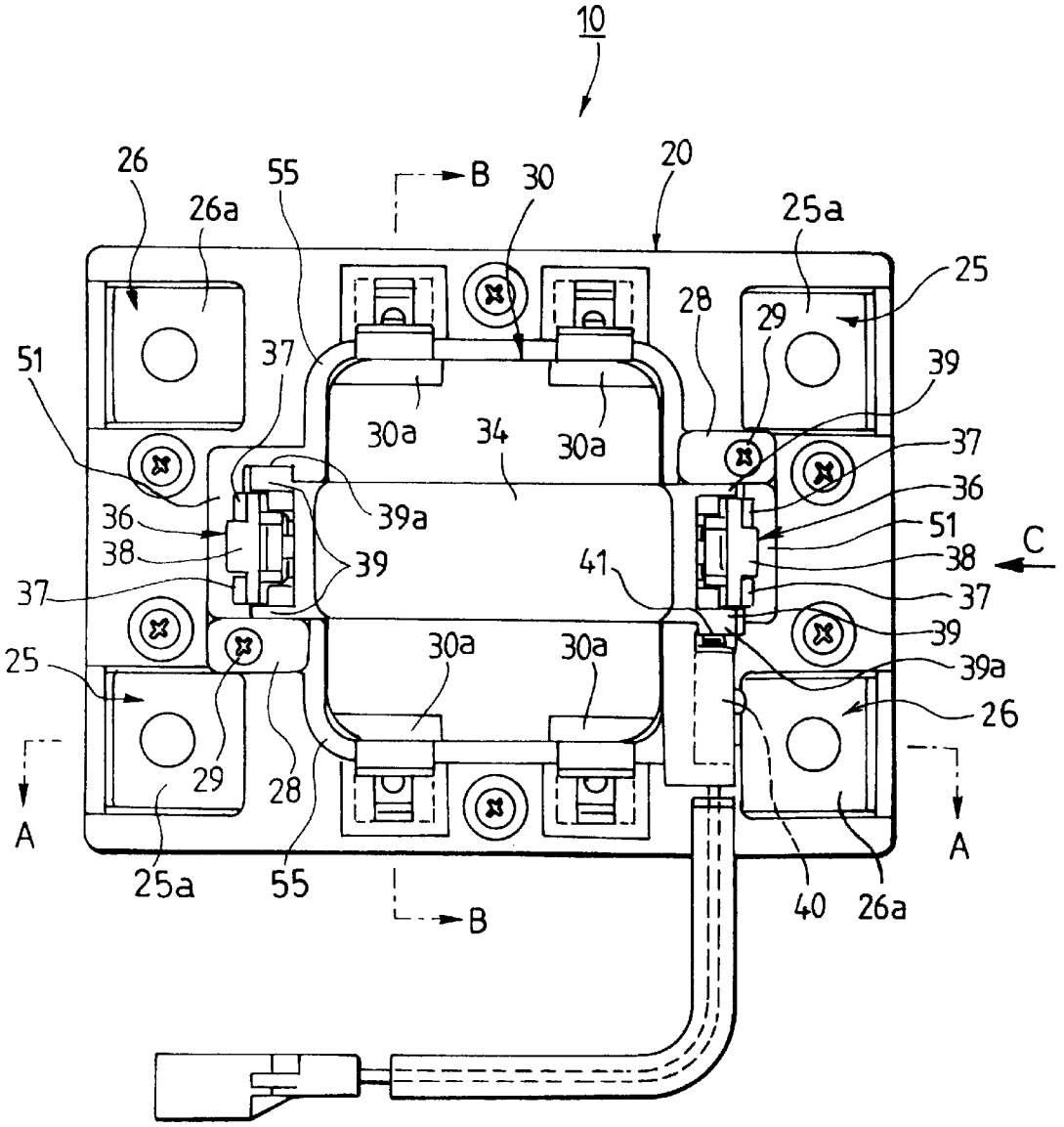
FIG. 3 is a plan view of the circuit breaking device shown in FIG. 1.
Figure 4:
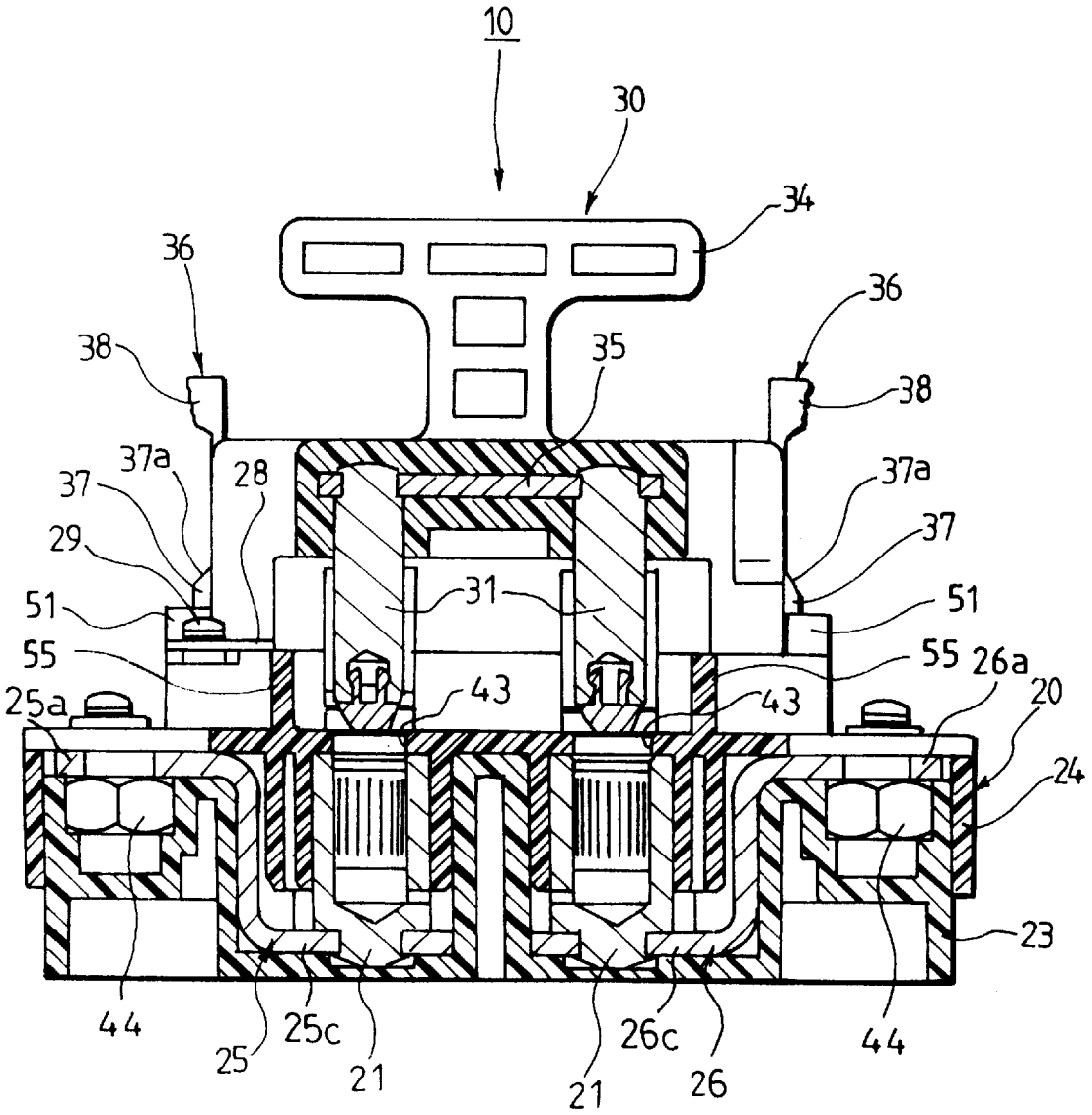
FIG. 4 is a section view taken along the arrow line A—A shown in FIG. 3.
Figure 5:
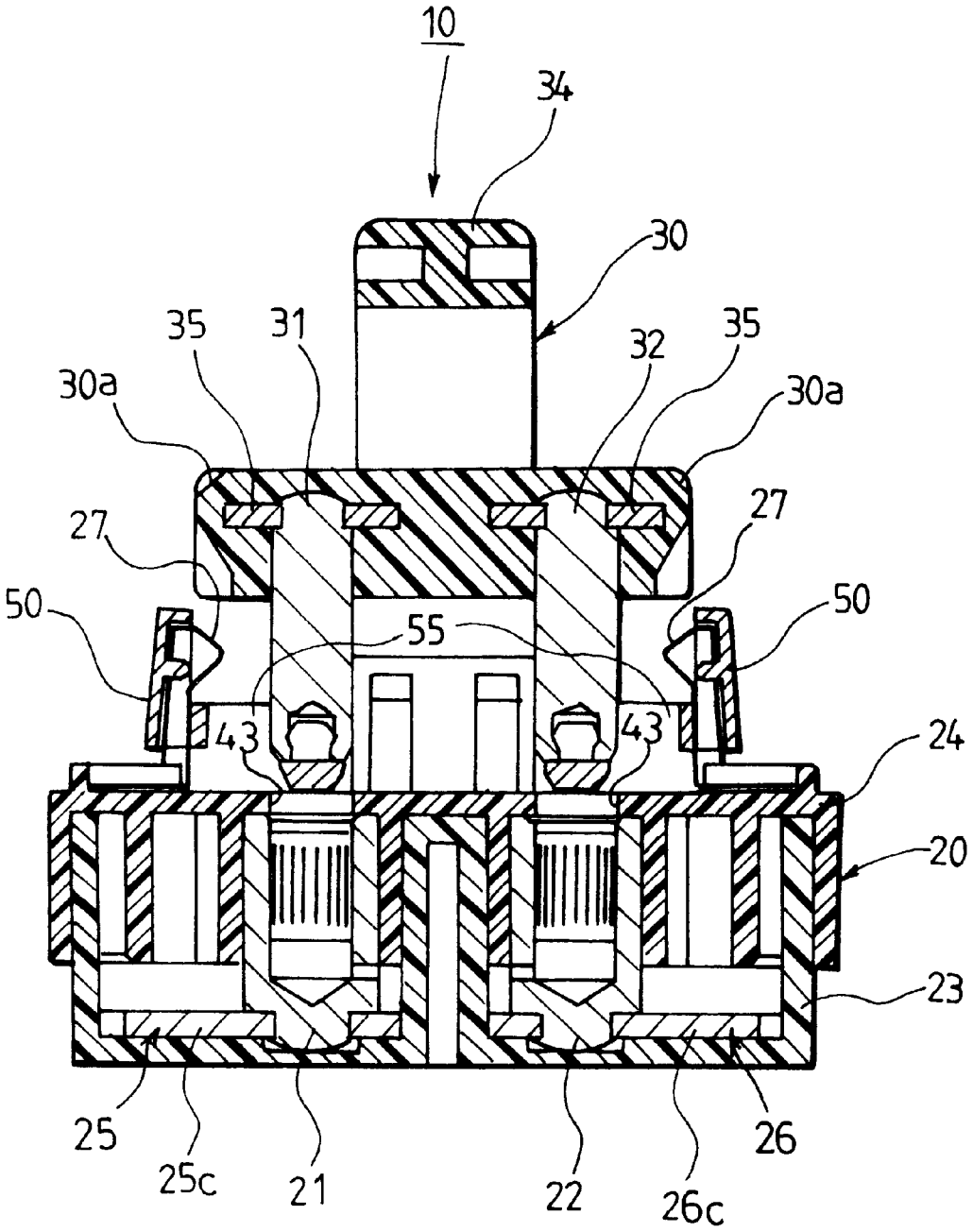
FIG. 5 is a section view taken along the arrow line B—B shown in FIG. 3.
Figure 6:
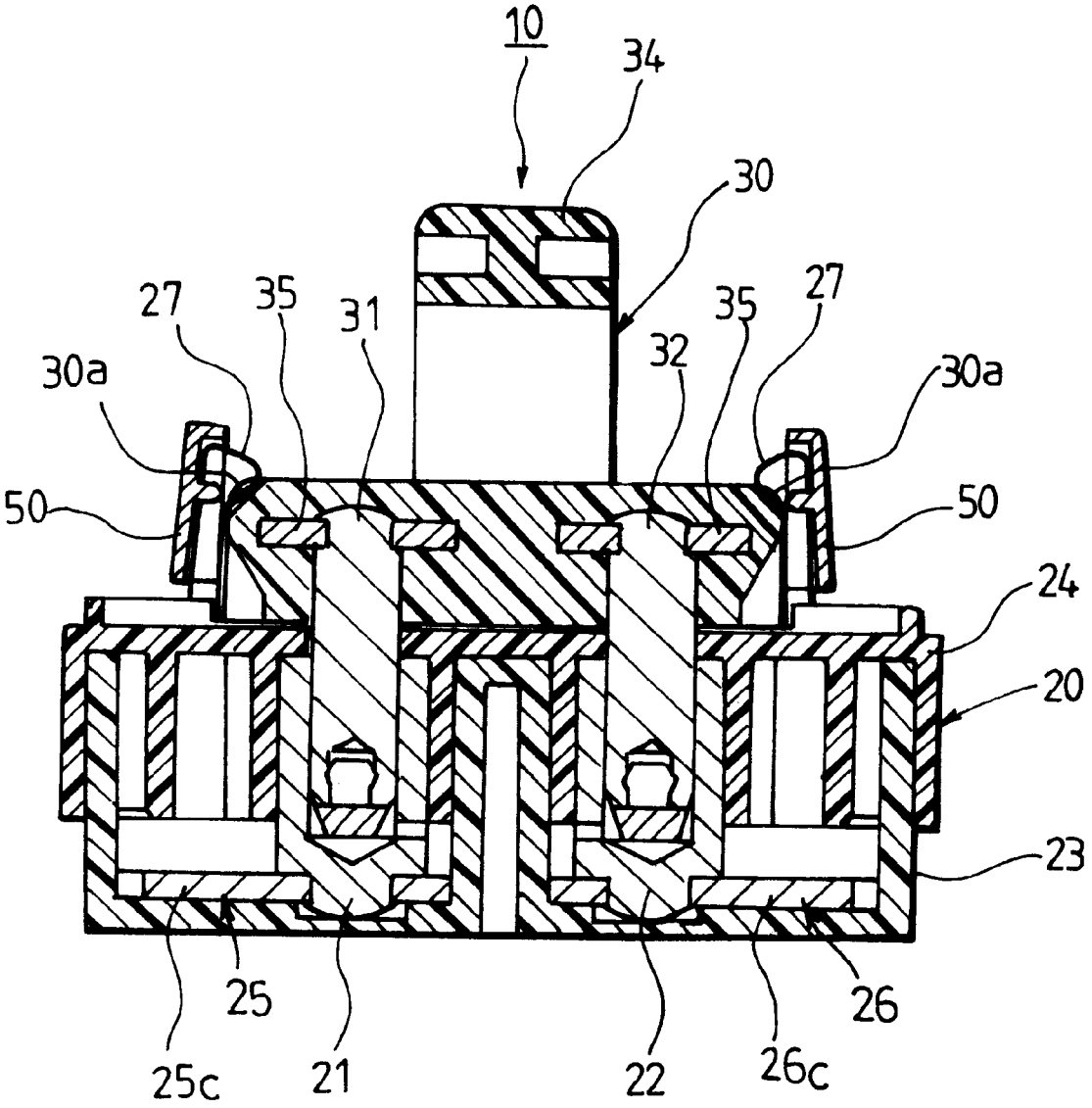
FIG. 6 is a longitudinal section view of the circuit breaking device shown in FIG. 1, showing an actually secured state thereof.
Figure 7:
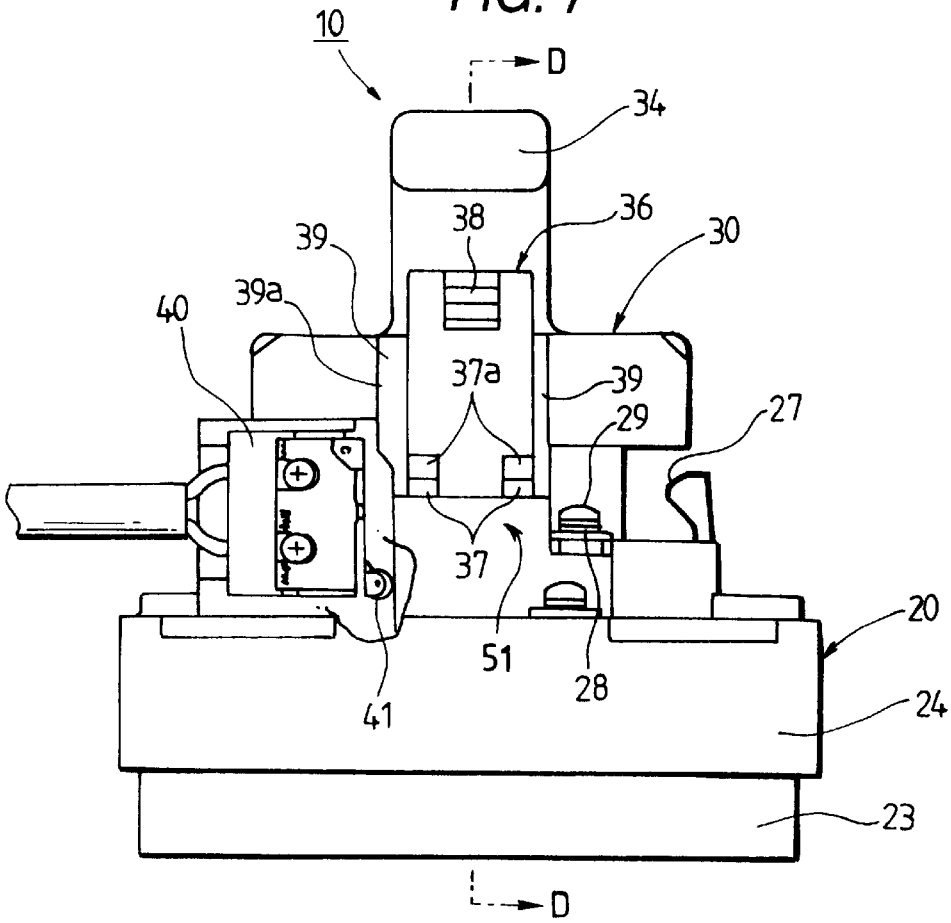
FIG. 7 is a side view the circuit breaking device shown in FIG. 1, when it is viewed from the arrow C shown in FIG. 3; and, FIG. 8 is a section view of a plug main body shown in FIG. 7, taken along the arrow line D—D shown in FIG. 7.
Figure 8:
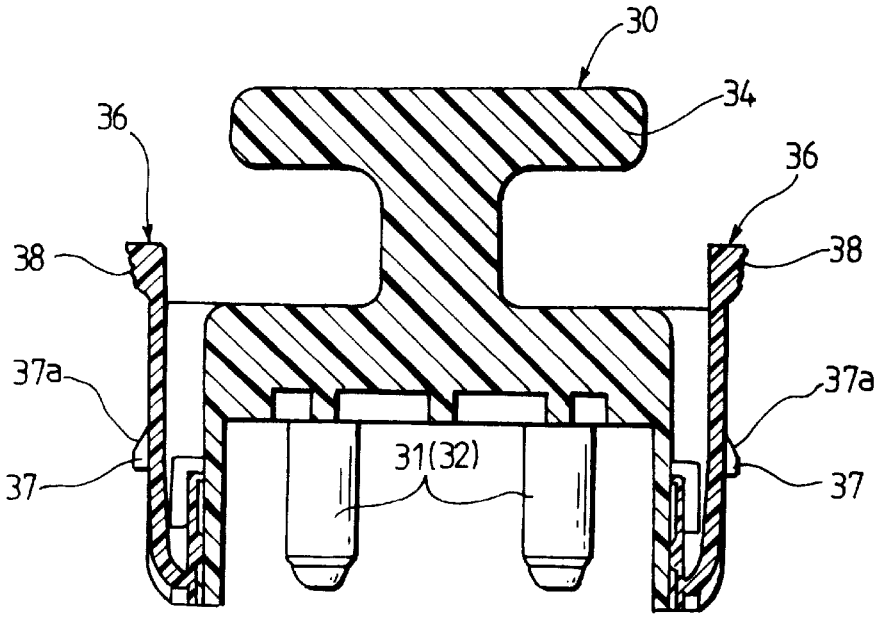

In particular, FIG. 1 is a perspective view of the whole structure of a circuit breaking device according to an embodiment of the invention, showing a temporarily secured state of the circuit breaking device; FIG. 2 is an exploded perspective view of the main portions of the circuit breaking device shown in FIG. 1; FIG. 3 is a plan view of the circuit breaking device shown in FIG. 1; FIG. 4 is a section view taken along the arrow line A—A shown in FIG. 3; FIG. 5 is a section view taken along the arrow line B—B shown in FIG. 3; FIG. 6 is a longitudinal section view of the circuit breaking device shown in FIG. 1, showing an actually secured state thereof; FIG. 7 is a section view taken along the arrow line C—C shown in FIG. 3; and, FIG. 8 is a section view of a plug main body shown in FIG. 7, taken along the arrow line D—D shown in FIG. 7.

As shown in FIGS. 1 and 2, a circuit breaking device 10 according to the present embodiment comprises a plug box 20 including circuit terminals 21, 21 and circuit terminals 22, 22 respectively connected to the respective open ends of two electric circuits (not shown), and a plug main body 30 disposed on the plug box 20 in such a manner that it can be shifted by a given amount; the plug main body 30 includes short-circuit terminals 31, 31 and short-circuit terminals 32, 32; and also, the plug main body 30 is capable of not only bringing the short-circuit terminals 31, 31 and short-circuit terminals 32, 32 into fit with the circuit terminals 21, 21 and circuit terminals 22, 22 of the plug box 20 to thereby shortcircuit them and thus close the two electric circuits respectively, but also disconnecting the short-circuit terminals 31, 31 and short-circuit terminals 32, 32 from the circuit terminals 21, 21 and circuit terminals 22, 22 to thereby open the two electric circuits and thus cut off the circuit currents of the two electric circuits.

And, the plug main body 30 is allowed to shift with respect to the plug box 20 between an actually securing position (see FIG. 6) where the short-circuit terminals 31 and 32 can be fitted with the circuit terminals 21 and 22 and a temporarily securing position (see FIG. 5) where the short-circuit terminals 31 and 32 can be removed from the circuit terminals 21 and 22.

The plug box 20, as shown in FIGS. 1 and 4, comprises a box main body 23 having a substantially rectangular parallelpiped shape, and a box cover 24 placed over and fixed to the box main body 23 in such a manner that the box cover 24 covers the upper surface of the box main body 23 in a proper manner.

At given positions of the box main body 23, there are disposed the circuit terminals 21, 21 and circuit terminals 22, 22 which are respectively formed in a substantially cylindrical shape and are paired with each other. The paired circuit terminals 21, 21 and circuit terminals 22, 22 are electrically connected to the respective open ends (not shown) of the two electric circuits respectively through bus bars 25 and 26.

That is, in the electric circuit connecting portions 25*a* and 26*a* of the bus bars 25 and 26, there are formed bolt insertion holes respectively; and, the open ends (not shown) of the two electric circuits (not shown) are tightened and fixed by mounting bolts (not shown) which can be threadedly engaged with insert nuts 44 stored within the box main body 23. Also, the lower end portions of the respective circuit terminals 21 and 22 are respectively caulked and fixed to the circuit terminal connecting portions 25*c* and 26*c* of the bus bars 25 and 26.

And, the male terminals of the plug main body 30, that is, the short-circuit terminals 31 and 32 are respectively fitted into the circuit terminals 21 and 22 through terminal insertion holes 43 which are respectively opened up in the box cover 24.

By the way, in the circuit breaking device 10 according to the present embodiment, due to provision of the above-mentioned paired circuit terminals 21, 21 and circuit terminals 22, 22, the two electric circuits can be cut off or closed at the same time.

However, the invention is not limited to this structure but, according to the present invention, there can also be employed a circuit breaking device which is able to cut off or close an electric circuit, or a circuit breaking device which is able to cut off or close three or more electric circuits at the same time.

On the top surface of the box cover 24, there are erected substantially rectangular-shaped protective peripheral side walls 55 which surround the terminal insertion holes 43 and cooperate with the plug main body 30 at its temporarily securing position (see FIG. 5) to be able to cover the circuit terminals 21, 21 and circuit terminals 22, 22. Thus, the plug main body 30 at its actually securing position is fitted into the protective peripheral side walls 55.

Also, on the top surface of the box cover 24, as shown in FIGS. 2, 3 and 5, there are disposed two pairs of actually securing springs 27, 27 which are opposed to each other with the plug main body 30, which has been fitted into the protective peripheral side walls 55, between them. The two pairs of actually securing springs 27, 27, which are respectively formed of bent formed plate springs, can be engaged with spring engaging surfaces 30*a*, 30*a* respectively formed in the shoulder portion of the plug main body 30, thereby being able to hold the plug main body 30 at the actually securing position with their elastic forces. By the way, on the outer surfaces of the actually securing springs 27, 27, as shown in FIG. 5, there are mounted preventive members 50 which are respectively formed of insulating material such as rubber, resin or the like to prevent the leak of the circuit current.

Further, at the two portions of the box cover 24 that are respectively located on a diagonal line in a plan view of the box cover 24 with the center thereof between them (see FIG. 3), a pair of plug main body removal preventive plates 28 which serve as plug main body preventive means and are fixed to the box cover 24 by their associated screws 29. The plug main body removal preventive plates 28 can be engaged with their associated removal preventive stepped portions 33 respectively formed in the plug main body 30 to thereby be able to prevent the plug main body 30 from shifting in a direction to part away from the plug box 20.

Accordingly, the plug main body 30 is allowed to shift with respect to the plug box 20 only between the actually securing position (see FIG. 6) where the short-circuit terminals 31 and 32 can be fitted with the circuit terminals 21 and 22, and the temporarily securing position (see FIG. 5) where the short-circuit terminals 31 and 32 can be removed from the circuit terminals 21 and 22; and, in particular, the plug main body 30 can be shifted to either of the temporarily securing position or the actually securing position by manually operating a substantially T-shaped operation lever 34 which is formed integrally with the plug main body 30.

The above-mentioned short-circuit terminals 31 and 32 are projectingly provided at the positions of the lower surface of the plug main body 30 that respectively correspond to the circuit terminals 21 and 22, and are respectively formed substantially cylindrical shapes which can be fitted with their associated circuit terminals 21 and 22. And, as shown in FIGS. 4 and 5, the short-circuit terminals 31, 31 and short-circuit terminals 32, 32 are electrically connected to each other respectively through their associated bus bars 35.

On the plug main body 30, as shown in FIG. 8, there are disposed a pair of flexible locking arms 36. In particular, according to the present embodiment, the respective locking arms 36 are produced as separate parts which are different in material from the plug main body 30, and are assembled and fixed to the plug main body 30 after they are produced separately.

That is, in the case of the plug main body 30, the material thereof is selected with a special emphasis placed on non-conductivity and heat resistance. Here, since material having high heat resistance is usually hard to flex, such material is not so preferable as the material of the locking arm. Thus, if the locking arm 36 is formed of material higher in flexibility than in heat resistance as a separate part and the base end portion of the thus formed locking arm 36 is thereafter assembled and fixed to the plug main body 30, then it is possible to structure the plug main body 30 including locking arms 36 which are respectively excellent in flexibility.

At the substantially central given positions of each of the locking arms 36 in the longitudinal direction thereof, there are disposed a pair of temporarily securing projections 37 which can be engaged with the portions to be secured 51 of the plug box 20 to thereby hold the plug main body 30 at the temporarily securing position and thus prevent the same from shifting to the actually securing position.

On the respective rear end side surfaces of the temporarily securing projections 37 in the fitting direction of the plug main body 30, there are formed tapered surfaces 37*a*; that is, the temporarily securing projections 37 respectively increase gradually in the height (in FIG. 8, the right-and-left direction dimension) from the top toward the bottom thereof in FIG. 8.

Also, on the respective free end portions of the locking arms 36, there are formed hold portions 38 respectively having a given position relation with respect to the operation lever 34 (that is, a position relation allowing the hold portion 38 to be held by the fingertips of one hand which is used to press and operate the operation lever 34). Due to this, when the operation lever 34 is pressed and operated by hand and the plug main body 30 is thereby shifted from the temporarily securing position to the actually securing position, the respective hold portions 38 are held from both sides, that is, from the right and left sides in FIG. 8 by the fingertips of one hand which is used to press and operate the operation lever 34, so that the locking arms 36 can be respectively flexed toward the center of the plug main body 30 with the base end portions thereof that are located in the lower portion of FIG. 8 as the fulcrums thereof.

That is, the respective locking arms 36 are structured such that, as shown in FIGS. 1 and 4, at the temporarily securing position of the plug main body 30, the temporarily securing projections 37 thereof are engaged with the upper surfaces of the portions to be secured 51 to thereby hold the plug main body 30 at the temporarily securing position thereof, which makes it possible to prevent the plug main body 30 from shifting to the actually securing position thereof. By the way, the temporarily securing projections 37 of the locking arms 36 are always energized in their engaging direction by the elastic forces of the locking arms 36 respectively.

Thus, when the plug main body 30 is pressed and shifted by hand from the temporarily securing position to the actually securing position, the respective hold portions 38 are held by the fingertips of one hand and are flexed toward the center of the plug main body 30, whereby the temporarily securing projections 37 of the respective locking arms 36 are removed from their engagement with the portions to be secured 51 and thus the locking arms 36 allow the plug main body 30 to shift to the actually securing position (in FIG. 1, to shift downward). On reaching the actually securing position, the temporarily securing projections 37 of the respective locking arms 36 are respectively stored within their associated recessed portions which form the tapered lower surfaces 51*a* of the portions to be secured 51 (see FIG. 2).

On the other hand, when the plug main body 30 is shifted from the actually securing position to the temporarily securing position, the tapered surfaces 37*a* of the temporarily securing projections 37 are respectively slidingly contacted with the tapered lower surfaces 51*a* of the portions to be secured 51 to thereby flex the locking arms 36 in their engagement removing direction, so that the plug main body 30 is allowed to shift to the temporarily securing position with no need to hold the respective hold portions 38 by the fingertips of one hand.

On the two sides of the plug main body 30 in the longitudinal direction of the respective locking arms 36, there are formed a pair of arm protect walls 39 which are opposed to each other with the locking arms 36 between them and also which are used to protect the locking arms 36 against external forces or the like. The respective arm protect walls 39 are formed such that they are projected slightly outwardly of the outer side surfaces of their associated locking arms 36.

Further, on the outer side surfaces of the arm protect walls 39 on a diagonal line in the plan view (see FIG. 3) of the plug main body 30 with the center of the plug main body 30 between them, there are formed expansion portions 39*a* each of which has a given shape and is projected by a given amount from its associated arm protect wall 39. In particular, each expansion portion 39*a* is structured such that, as shown in FIG. 7, as the plug main body 30 is operated or shifted, the expansion portion 39*a* swings a driven member 41 of a microswitch 40 to thereby change over the microswitch 40 into its on state or off state.

That is, at the temporarily securing position of the plug main body 30, the expansion portion 39*a* is not in engagement with the driven member 41 of the microswitch 40 and thus the microswitch 40 is held in the off state. Also, at the actually securing position of the plug main body 30, the expansion portion 39*a* is engaged with the driven member 41 of the microswitch 40 to thereby swing the driven member 41 and thus change over the microswitch 40 into the on state. As a result of this, the microswitch 40 detects the actually securing position of the plug main body 30 (in particular, the fitting engagement of the short-circuit terminals 31, 32 with the circuit terminals 21, 22).

Next, description will be given below of the operation of the circuit breaking device 10 according to the present embodiment.

In checking and maintaining an electric car or the like, an operator pulls up the operation lever 34 of the plug main body 30 with one hand in a direction to part away from the plug box 20 (in FIG. 7, in the upward direction) and, while flexing the actually securing springs 27, shifts the plug main body 30 from the actually securing position to the temporarily securing position. As a result of this, the two electric circuits are respectively opened to thereby cut off the circuit currents thereof. At the then time, the locking arms 36, in particular, the tapered surfaces 37*a* of the temporarily securing projections 37 of the locking arms 36 are slidingly contacted with the tapered lower surfaces 51*a* of the portions to be secured 51 and are thereby flexed, which allows the plug main body 30 to shift to the temporarily securing position with no need to hold the respective hold portions 38 by the fingertips of one hand.

And, the plug main body 30 is engaged with the removal preventive stepped portions 33 of the plug main body removal preventive plates 28 and is thereby prevented at the temporarily securing position from shifting in a direction to part away from the plug box 20 and, at the same time, since the temporarily securing projections 37 of the locking arm 36*s* are engaged with the upper surfaces 51*a* of the portions to be secured 51, the plug main body 30 is prevented at the temporarily securing position from shifting to the actually securing position as well, so that the plug main body 30 can be positively held at the temporarily securing position.

After the operator has finished the checking and maintenance of the electric car, when shifting the plug main body 30 from the temporarily securing position to the actually securing position, the operator may hold the hold portions 38 of the locking arms 36 respectively by the fingertips of one hand for operating the operation lever 34 of the plug main body 30 and, while flexing the locking arms 36 respectively, may press and operate the operation lever 34 of the plug main body 30 (that is, the operator may take two actions). As a result of this, the plug main body 30 is shifted to the actually securing position while flexing the actually securing springs 27 and, at the actually securing position, the plug main body 30 is held by the elastic forces of the present actually securing springs 27.

That is, according to the circuit breaking device 10 of the present embodiment, the plug main body 30 is allowed to shift with respect to the plug box 20 only between the actually securing position where the short-circuit terminals 31, 32 can be fitted with the circuit terminals 21, 22 (see FIG. 6) and the temporarily securing position where the short-circuit terminals 31, 32 can be removed from the circuit terminals 21, 22 (see FIG. 5), so that the plug main body 30 can be prevented against removal from the plug box 20 in either of these two positions.

Due to this, even when the electric circuits are cut off, the plug main body 30 cannot be removed from the plug box 20 completely, which not only can eliminate a fear that the plug main body 30 can be lost in error, but also allows the plug main body 30 at the temporarily securing position to cover the upper portions of the circuit terminals 21 and 22. In addition to this, in the plug box 20, there are disposed the protective peripheral side walls 55 which can cooperate with the plug main body 30 at the temporarily securing position in covering the circuit terminals 21 and 22; that is, the protective peripheral side walls 55 are able to cover the obliquely upper portions of the circuit terminals 21 and 22 that cannot be covered completely only by the plug main body 30.

Therefore, there is eliminated a fear that, even when the electric circuits are cut off, the fingertips of the operator or conductive parts (such as a wire and the like) can be contacted with the circuit terminals 21 and 22 within the terminal insertion holes by accident, which makes it sure to be able to avoid a trouble such as an electric shock or the like.

Also, even if the operator tries to shift the plug main body 30 at the temporarily securing position further in the direction to part away from the plug box 20 with a greater operation force than necessary, the plug main body 30, which is blocked by the plug main body removal preventive plates 28, is prevented from shifting any further; that is, there is no possibility that the plug main body 30 can be removed from the plug box 20 by accident.

Further, to shift the plug main body 30 from the temporarily securing position to the actually securing position, there are required two operations: that is, in one operation, the locking arms 36 are respectively flexed to thereby remove the engagement between the temporarily securing projections 37 of the locking arm 36*s* and the portions to be secured 51; and, in the other operation, the plug main body 30 is shifted from the temporarily securing position to the actually securing position. Therefore, according to the present plug main body 30, since the fitting operation to fit the short-circuit terminal 31 and 32 with the circuit terminals 21 and 22 is carried out in two stages or two actions, there is no possibility that, even if the plug main body 30 at the temporarily securing position is energized unexpectedly by an external force in the actually securing position direction, the short-circuit terminal 31 and 32 can be fitted with the circuit terminals 21 and 22 in error.

On the other hand, to shift the plug main body 30 from the actually securing position to the temporarily securing position, the operator may only have to pull up the operation lever 34 of the plug main body 30 at the actually securing position in the direction to part away from the plug box 20 by one hand, with no need for the operation to flex the locking arms 36. Accordingly, by removing the short-circuit terminal 31 and 32 of the plug main body 30 from the circuit terminals 21 and 22, the cutoff operation to open the two electric circuits to thereby cut off the circuit current thereof can be turned into one action, which makes it possible to facilitate the cutoff operation.

Therefore, the operator not only can execute the shifting operation of the plug main body 30 from the temporarily securing position to the actually securing position by one-hand operation of two actions (that is, the action to hold the locking arms 36 and the action to press the operation lever 34), but also can carry out the shifting operation of the plug main body 30 from the actually securing position to the temporarily securing position by one action (that is, the action to pull up the operation lever 34), so that the plug main body 30 can provide a very high efficiency in its position shifting operation.

By the way, a circuit breaking device according to the invention is not limited to the structure of the above-mentioned embodiment but, of course, there can be employed other various structures.

As has been described heretofore, according to the circuit breaking device of the invention, since the plug main body is allowed to shift with respect to the plug box between the actually securing position where the short-circuit terminals can be fitted with the circuit terminals and the temporarily securing position where the short-circuit terminals can be removed from the circuit terminals, in checking and maintaining an electric car or the like, an operator, by shifting the plug main body from the actually securing position to the temporarily securing position, can remove the short-circuit terminals from the circuit terminals of the plug box to thereby open the electric circuits and thus cut off the circuit currents thereof.

In this manner, even if the electric circuits are cut off, the plug main body is prevented against complete separation from the plug box, and thus the plug main body at the temporarily securing position is able to cover the upper portions of the circuit terminals of the plug box.

Therefore, there is eliminated the possibility that, even if the electric circuits are cut off, the plug main body can be separated completely from the plug box, which in turn eliminate a fear that the plug main body can be lost in error. Also, there is eliminated a fear that, even when the electric circuits are cut off, the fingertips of the operator or conductive parts (such as a wire and the like) can be contacted with the circuit terminals within the terminal insertion holes by accident, which makes it sure to be able to avoid a trouble such as an electric shock or the like.

What is claimed is:

1. A circuit breaking device comprising:

a plug box including a circuit terminal connected to the open end of an electric circuit; and a plug main body including a short-circuit terminal, disposed in such a manner that said plug main body is shifted within a predetermined amount with respect to said plug box, said plug main body being not only to bring said short-circuit terminal into fit with said circuit terminal of said plug box to close said electric circuit but also to remove said short-circuit terminal from said circuit terminal to open said electric circuit and thus cut off a circuit current thereof, wherein said plug main body is allowed to shift with respect to said plug box between an actually securing position, where said short-circuit terminal can be fitted with said circuit terminal, and a temporarily securing position where said short-circuit terminal can be removed from said circuit terminal, and wherein said plug box includes protective peripheral side walls which cooperate with said plug main body at said temporarily securing position so as to cover said circuit terminal.

2. A circuit breaking device as set forth in claim 1, wherein said plug main body is prevented, at said temporarily securing position, from shifting further away from said plug box by a plug main body removal preventive device disposed in said plug box.

3. A circuit breaking device as set forth in claim 2, wherein said plug main body is projectingly provided with a pair of arm protective walls, and said pair of arm protective walls are opposed to each other with a flexible locking arm between them so as to protect said flexible locking arm.

4. A circuit breaking device as set forth in claim 1, further comprising:

a flexible locking arm formed in said plug main body, wherein said plug main body is held at said temporarily securing position in such a manner that a temporarily securing projection provided on said flexible locking arm is engaged with a portion to be secured on said plug box, and to shift said plug main body from said temporarily securing position to said actually securing position, said flexible locking arm is flexed while said plug main body is shifted to thereby remove the engagement between said temporarily securing projection and said portion to be secured.

5. A circuit breaking device as set forth in claim 4, wherein a tapered surface is formed between said temporarily securing projection and said portion to be secured, when shifting said plug main body from said temporarily securing position to said actually securing position, said tapered surface flex said locking arm in an engagement removing direction to thereby remove the engagement of said temporarily securing projection with respect to said portion to be secured.

6. A circuit breaking device as set forth in claim 4, wherein said plug main body is projectingly provided with a pair of arm protective walls, and said pair of arm protective walls are opposed to each other with said flexible locking arm between them so as to protect said flexible locking arm.

7. A circuit breaking device, comprising:

a plug box having a rectangular shape and a circuit terminal connected to an open end of an electric circuit;

a plug main body for engaging with said plug box in a secured position or a temporary position, said plug main body having a short-circuit terminal which fits with said circuit terminal when said plug main body is engaged with said plug box in said secured position;

a pair of peripheral side walls on said plug box so that said circuit terminal is disposed between said pair of peripheral side walls, wherein said pair of peripheral side walls protect said circuit terminal when said plug main body is engaged with said plug box in said temporary position;

a pair of securing portions on said plug box so that said circuit terminal is disposed between said pair of securing portions, wherein said pair of securing portions engage with a plurality of temporary securing projections on said plug main body to hold said plug main body in said temporary position; and a plurality of securing springs on said plug box which engage with said plug main body to hold said plug main body in said secured position, wherein said pair of peripheral side walls, said pair of securing portions and said plurality of securing springs are each separate elements and are disposed along a rectangular perimeter around said circuit terminal for engaging with said plug main body so that said plug main body is limited to movement between said temporary position and said secured position.

* * * * *